US010156005B2

(12) United States Patent
Takashima et al.

(10) Patent No.: US 10,156,005 B2
(45) Date of Patent: Dec. 18, 2018

(54) HIGH-YIELD-RATIO, HIGH-STRENGTH COLD ROLLED STEEL SHEET AND PRODUCTION METHOD THEREFOR

(71) Applicant: JFE Steel Corporation, Tokyo (JP)

(72) Inventors: Katsutoshi Takashima, Tokyo (JP); Yoshihiko Ono, Tokyo (JP); Kohei Hasegawa, Tokyo (JP)

(73) Assignee: JFE Steel Corporation (JP)

( * ) Notice: Subject to any disclaimer, the term of this patent is extended or adjusted under 35 U.S.C. 154(b) by 278 days.

(21) Appl. No.: 14/911,088

(22) PCT Filed: Jul. 18, 2014

(86) PCT No.: PCT/JP2014/003825
§ 371 (c)(1),
(2) Date: Feb. 9, 2016

(87) PCT Pub. No.: WO2015/019557
PCT Pub. Date: Feb. 12, 2015

(65) Prior Publication Data

US 2016/0177427 A1 Jun. 23, 2016

(30) Foreign Application Priority Data

Aug. 9, 2013 (JP) ..... 2013-165771

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/12*** | (2006.01) |
| ***C21D 9/46*** | (2006.01) |
| ***C21D 8/02*** | (2006.01) |
| ***C22C 38/38*** | (2006.01) |
| ***C22C 38/00*** | (2006.01) |
| ***C22C 38/08*** | (2006.01) |
| ***C22C 38/16*** | (2006.01) |
| ***C22C 38/28*** | (2006.01) |
| ***C22C 38/32*** | (2006.01) |
| ***C21D 1/84*** | (2006.01) |
| ***C21D 6/00*** | (2006.01) |
| ***C21D 8/04*** | (2006.01) |
| ***C21D 1/25*** | (2006.01) |

(52) U.S. Cl.

CPC ..... *C22C 38/38* (2013.01); *C21D 1/25* (2013.01); *C21D 1/84* (2013.01); *C21D 6/004* (2013.01); *C21D 6/005* (2013.01); *C21D 6/008* (2013.01); *C21D 8/0205* (2013.01); *C21D 8/0221* (2013.01); *C21D 8/0226* (2013.01); *C21D 8/0236* (2013.01); *C21D 8/0263* (2013.01); *C21D 8/0278* (2013.01); *C21D 8/0463* (2013.01); *C21D 8/0473* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/32* (2013.01); *C21D 9/46* (2013.01); *C21D 2211/001* (2013.01); *C21D 2211/002* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2012/0175028 | A1 | 7/2012 | Matsuda et al. | |
| 2013/0133792 | A1* | 5/2013 | Nakagaito | C21D 1/25 148/645 |
| 2014/0342184 | A1* | 11/2014 | Takagi | C22C 38/001 428/659 |

FOREIGN PATENT DOCUMENTS

| | | | | |
|---|---|---|---|---|
| EP | 2 426 230 | | 3/2012 | |
| EP | 2 604 715 | | 6/2013 | |
| EP | 2 765 212 | | 8/2014 | |
| JP | 2002-302734 | A | 10/2002 | |
| JP | 2005-2404 | A | 1/2005 | |
| JP | 2005-240178 | A | 9/2005 | |
| JP | 2010-059452 | * | 3/2010 | C22C 38/14 |
| JP | 2010-196115 | | 9/2010 | |
| JP | 2011-47034 | A | 3/2011 | |
| JP | 2011-144404 | | 7/2011 | |
| JP | 2012-237042 | | 12/2012 | |

(Continued)

OTHER PUBLICATIONS

Machine-English translation of Japanese patent No. 2010-059452 A, Matsuda Hideki et al. Mar. 18, 2010.*

(Continued)

*Primary Examiner* — Deborah Yee
(74) *Attorney, Agent, or Firm* — DLA Piper LLP (US)

(57) ABSTRACT

A steel sheet includes a microstructure containing a volume fraction of 20% to 55% of ferrite having an average grain size of 7 μm or less, a volume fraction of 5% to 15% of retained austenite, a volume fraction of 0.5% to 7% of martensite having an average grain size of 4 μm or less, and a structure composed of bainite and/or tempered martensite and having an average grain size of 6 μm or less, and a difference in nano-hardness between ferrite and the structure composed of bainite and/or tempered martensite being 3.5 GPa or less and a difference in nano-hardness between the structure composed of bainite and/or tempered martensite and martensite being 2.5 GPa or less.

12 Claims, No Drawings

(56) References Cited

FOREIGN PATENT DOCUMENTS

| | | |
|---|---|---|
| WO | 2013/051238 | 4/2013 |
| WO | 2013/099235 A1 | 7/2013 |

OTHER PUBLICATIONS

Supplementary European Search Report dated Jun. 10, 2016, of corresponding European Application No. 14834702.4.
Chinese Office Action dated Sep. 26, 2016, of corresponding Chinese Application No. 201480045257.7, along with a Search Report in English.
Korean Office Action dated Nov. 30, 2016, of corresponding Korean Application No. 10-2016-7003756, along with a Concise Statement of Relevance of Office Action in English.
"Handbook of X-ray Diffraction", *Rigaku Denki Corporation*, 2000, pp. 26 and 62-64, along with a partial English translation.

* cited by examiner

HIGH-YIELD-RATIO, HIGH-STRENGTH COLD ROLLED STEEL SHEET AND PRODUCTION METHOD THEREFOR

TECHNICAL FIELD

This disclosure relates to high-strength cold rolled steel sheets having high yield ratios and production methods therefor and, particularly, to a high-strength cold rolled steel sheet suitable as materials for structural parts of automobiles and the like.

BACKGROUND

In recent years, $CO_2$ emissions have been strictly regulated due to increasing environmental concerns. In the field of automobiles, weight reduction of car bodies and improvements in fuel efficiency have emerged as major challenges. Accordingly, automobile parts have become increasingly thinner by the increasing use of high-strength steel sheets. In particular, high-strength steel sheets having a tensile strength (TS) of 980 MPa or higher are now being increasingly used in automobile parts.

High-strength steel sheets used in automobile parts such as structural parts and reinforcement parts of automobiles are required to have excellent formability. In particular, high-strength steel sheets for use in parts having complicated shapes are required to excel in not only one of but both elongation and stretch flangeability (also referred to as hole expandability). Automobile parts such as structural parts and reinforcement parts described above are also required to have excellent impact energy absorption capability. To improve the impact energy absorption capability, it is effective to increase the yield ratio of the steel sheet used. Automobile parts that use steel sheets having high yield ratios can absorb impact energy efficiently at low deformation. The yield ratio (YR) discussed here is a value of the ratio of the yield stress (YS) to the tensile strength (TS) and is expressed as YR=YS/TS.

Heretofore, dual phase steels (DP steels) having a ferrite-martensite structure have been known as high-strength thin steel sheets that have both high strength and formability. An example of steel sheets having high strength and excellent ductility is TRIP steel sheets that use transformation induced plasticity of retained austenite. TRIP steel sheets have a steel sheet structure containing retained austenite. When TRIP steel sheets are worked and deformed at a temperature equal to or higher than a martensite transformation start temperature, retained austenite is induced to transform into martensite by stress and a large elongation is obtained. However, TRIP steel sheets have a problem in that transformation of retained austenite into martensite during a punching process causes cracks to occur at the interfaces with ferrite and degrades hole expandability (stretch flangeability).

An example of a steel sheet having stretch flangeability improved from the TRIP steel sheets is described in, for example, Japanese Unexamined Patent Application Publication No. 2005-240178 which discloses a high-strength cold rolled steel sheet having excellent elongation and stretch flangeability and a steel structure that satisfies the following: retained austenite: at least 5%, bainitic ferrite: at least 60%, and polygonal ferrite: 20% or less (including 0%). Japanese Unexamined Patent Application Publication No. 2002-302734 discloses a high-strength steel sheet having excellent elongation and stretch flangeability, the steel sheet containing 50% or more of tempered martensite as a base structure in terms of occupation ratio in the entire structure, and 3% to 20% of retained austenite as a second phase structure in terms of occupation ratio in the entire structure.

Generally speaking, DP steels have low yield ratios since mobile dislocations are introduced into ferrite during martensite transformation and thus have low impact energy absorption capability. A steel sheet of Japanese Unexamined Patent Application Publication No. 2005-240178, which is a TRIP steel sheet that makes use of retained austenite, has insufficient elongation relative to strength and it is difficult to obtain sufficient elongation in a high-strength region where TS is 980 MPa or higher. According to Japanese Unexamined Patent Application Publication No. 2002-302734, steel sheets described as having excellent elongation and stretch flangeability specifically disclosed in Examples have low yield ratios, and TS thereof is at the 590 to 940 MPa level. Thus, those steel sheets do not have excellent elongation and stretch flangeability in a high strength region of 980 MPa or higher, and high yield ratios.

As discussed above, it is difficult for a high-strength steel sheet having a tensile strength of 980 MPa or higher to have a high yield ratio to maintain excellent impact energy absorption capability, and assure elongation and stretch flangeability to maintain excellent formability. A steel sheet having all these properties is desirable.

It could therefore be helpful to provide a high-yield-ratio, high-strength cold rolled steel sheet having excellent elongation and stretch flangeability and a production method therefor.

SUMMARY

We thus provide:

[1] A high-yield-ratio, high-strength cold rolled steel sheet comprising a composition and a microstructure, the composition containing in terms of percent by mass, C: 0.05% to 0.15%, Si: 0.6% to 2.5%, Mn: 2.2% to 3.5%, P: 0.08% or less, S: 0.010% or less, Al: 0.01% to 0.08%, N: 0.010% or less, Ti: 0.002% to 0.05%, B: 0.0002% to 0.0050%, and the balance being Fe and unavoidable impurities, the microstructure containing a volume fraction of 20% to 55% of ferrite having an average grain size of 7 μm or less, a volume fraction of 5% to 15% of retained austenite, a volume fraction of 0.5% to 7% of martensite having an average grain size of 4 μm or less, and a structure composed of bainite and/or tempered martensite and having an average grain size of 6 μm or less, and a difference in nano-hardness between the ferrite and the structure composed of bainite and/or tempered martensite being 3.5 GPa or less and a difference in nano-hardness between the structure composed of bainite and/or tempered martensite and the martensite being 2.5 GPa or less.

[2] The high-yield-ratio, high-strength cold rolled steel sheet described in [1] above, the composition further comprises, in terms of percent by mass, at least one selected from V: 0.10% or less and Nb: 0.10% or less.

[3] The high-yield-ratio, high-strength cold rolled steel sheet described in [1] or [2] above, the composition further comprises, in terms of percent by mass, at least one selected from Cr: 0.50% or less, Mo: 0.50% or less, Cu: 0.50% or less, and Ni: 0.50% or less.

[4] The high-yield-ratio, high-strength cold rolled steel sheet described in any one of [1] to [3] above, the composition further comprises, in terms of percent by mass, at least one selected from Ca: 0.0050% or less and REM: 0.0050% or less.

[5] A method of producing a high-yield-ratio, high-strength cold rolled steel sheet, comprising:

preparing a steel slab having a chemical composition described in any one of [1] to [4] above, hot-rolling the steel slab under conditions of hot rolling start temperature: 1150° C. to 1300° C. and finishing delivery temperature: 850° C. to 950° C., starting cooling within 1 s after completion of hot rolling, performing cooling to 650° C. or lower at a first average cooling rate of 80° C./s or more as first cooling, performing cooling to 550° C. or lower at a second average cooling rate of 5° C./s or more as second cooling, performing coiling at a coiling temperature: 550° C. or lower, performing pickling and cold-rolling, performing heating to a temperature zone of 750° C. or higher at an average heating rate of 3 to 30° C./s, holding a first soaking temperature of 750° C. or higher for 30 s or longer, performing cooling from the first soaking temperature to a cooling end temperature in a temperature zone of 150° C. to 350° C. at a third average cooling rate of 3° C./s or more, performing heating to a second soaking temperature in a temperature zone of 350° C. to 500° C., holding the second soaking temperature for 20 s or longer, and performing cooling to room temperature.

A high-yield-ratio, high-strength cold rolled steel sheet having excellent elongation and stretch flangeability can be stably obtained by controlling the composition and the microstructure of the steel sheet.

DETAILED DESCRIPTION

We found that high ductility and excellent stretch flangeability can be both obtained while maintaining a high yield ratio, by forming a microstructure in which average grain sizes of ferrite and martensite are within particular ranges, volume fractions of ferrite, martensite, and retained austenite are within particular ranges, and the balance is mainly bainite and/or tempered martensite having average grain sizes within particular ranges, and by controlling the difference in hardness between ferrite and a structure composed of bainite and/or tempered martensite and the difference in hardness between a structure composed of bainite and/or tempered martensite and martensite.

First, we studied the relationship between the steel sheet structure and properties such as tensile strength, yield ratio, elongation, stretch flangeability and the like, and observed:

a) When martensite or retained austenite is present in the steel sheet structure, voids occur at the interface with ferrite during a punching process in a hole expansion test, and voids become connected to one another and propagate in the subsequent hole-expanding process, resulting in occurrence of cracks. Accordingly, it is difficult to obtain excellent stretch flangeability.

b) Bainite or tempered martensite having high dislocation densities in a steel sheet structure increases the yield strength. Thus a high yield ratio and excellent stretch flangeability can be obtained. However, in this case, elongation is decreased.

c) Soft ferrite and retained austenite is effective for improving elongation. However, this decreases tensile strength and stretch flangeability.

d) Addition of an appropriate amount of Si to steel causes solid solution strengthening of ferrite and addition of an appropriate amount of B increases hardenability. Use of B, instead of hardening elements that increase hardness of martensite and tempered martensite, suppresses the increase in hardness of martensite. Furthermore, the volume fraction of a hard phase, which causes voids, is adjusted. Tempered martensite and bainite, which are hard intermediate phases, are introduced to the steel sheet structure. The average grain sizes of ferrite and martensite are decreased. As a result, the number of voids that occur during a punching process can be decreased, and connecting of voids that occurs during hole expansion can be suppressed. Thus, hole expandability (stretch flangeability) can be improved while maintaining elongation and yield ratio.

e) Excessive addition of hardening elements lowers the martensite transformation start temperature, and thus the cooling end temperature must be decreased to obtain the required tempered martensite volume fraction, requiring extra cooling performance and increasing the cost. In contrast, hardenability can be obtained without decreasing the martensite transformation start temperature when B is used. Accordingly, the cost required to cool can be saved by using B as a hardening element.

f) During cooling after finish rolling in hot rolling, B can suppress generation of ferrite and pearlite. Addition of B causes the steel sheet structure of a hot rolled steel sheet to turn into a bainite homogeneous structure, and grain size reduction and nano-hardness difference can be controlled by performing rapid heating during subsequent annealing.

We thus found that elongation and stretch flangeability can be improved while maintaining high yield ratio if Si: 0.6 to 2.5% and B: 0.0002 to 0.0050% in terms of percent by mass are added and when hot rolling, cold rolling, and then a heat treatment involving annealing are performed under appropriate conditions so that the difference in nano-hardness between ferrite and bainite and/or tempered martensite is 3.5 GPa or less, the difference in nano-hardness between bainite and/or tempered martensite, and martensite is 2.5 GPa or less, and volume fractions of ferrite, retained austenite, and martensite are controlled within the ranges that do not impair strength and ductility.

Reasons for limiting the contents of the components in a high-strength cold rolled steel sheet are described. The notation "%" for chemical components of steels means % by mass.

C: 0.05 to 0.15%

Carbon (C) is an element that increases strength of a steel sheet. C contributes to increasing strength by forming a second phase such as bainite, tempered martensite, retained austenite or martensite. It is difficult to obtain a required second phase at a C content less than 0.05%. Thus, the C content is 0.05% or more and preferably 0.07% or more. At a C content exceeding 0.15%, the difference in nano-hardness between ferrite and bainite and/or tempered martensite and the difference in nano-hardness between bainite and/or tempered martensite and martensite increase and thus stretch flangeability is degraded. Accordingly, the C content is 0.15% or less and preferably 0.14% or less.

Si: 0.6 to 2.5%

Silicon (Si) is a ferrite-forming element and an element effective for solid solution strengthening. The Si content needs to be 0.6% or more to improve the balance between strength and ductility and ensure hardness of ferrite. Preferably, the Si content is 0.8% or more. Since addition of excessive Si degrades chemical conversion treatability, the Si content is 2.5% or less and preferably 2.1% or less.

Mn: 2.2 to 3.5%

Manganese (Mn) is an element that causes solid solution strengthening of steel and contributes to increasing strength by forming a second phase structure. It is also an element that stabilizes austenite and is needed to control the fraction of the second phase. Moreover, manganese is needed to homogenize the structure of a hot rolled steel sheet through bainite transformation. The Mn content needs to be 2.2% or more to obtain these effects. Excessive addition of Mn excessively increases the volume ratio of martensite and thus the Mn content is 3.5% or less. The Mn content is preferably 3.0% or less.

P: 0.08% or Less

Phosphorus (P) contributes to increasing strength by solid solution strengthening. Addition of excessive phosphorus, however, causes extensive segregation at grain boundaries, makes grain boundaries brittle, and decreases weldability. Accordingly, the P content is 0.08% or less and preferably 0.05% or less.

S: 0.010% or Less

At a high S content, sulfides such as MnS occur extensively, and local elongation such as stretch flangeability is degraded. Thus, the S content is 0.010% or less and preferably 0.0050% or less. The S content has no particular lower limit. The S content is preferably 0.0005% or more since the steel making cost increases to significantly decrease the S content.

Al: 0.01 to 0.08%

Aluminum (Al) is an element needed for deoxidation and the Al content needs to be 0.01% or more to obtain this effect. Since the effect is saturated at an Al content exceeding 0.08%, the Al content is 0.08% or less and preferably 0.05% or less.

N: 0.010% or Less

Nitrogen (N) forms coarse nitrides and tends to degrade bendability and stretch flangeability. Thus, the N content is preferably low. This tendency becomes notable at an N content exceeding 0.010%. Thus, the N content is 0.010% or less and preferably 0.0050% or less.

Ti: 0.002 to 0.05%

Titanium (Ti) is an element that contributes to increasing strength by forming fine carbonitrides. Since Ti is more likely to react with N than B, Ti is needed to prevent B, which is an essential element from reacting with N. The Ti content needs to be 0.002% or more and is preferably 0.005% or more to obtain this effect. The Ti content is 0.05% or less and preferably 0.035% or less since addition of excessive Ti significantly decreases elongation.

B: 0.0002 to 0.0050%

Boron (B) is an element that improves hardenability and contributes to increasing strength by forming a second phase. Moreover, B is also an element that prevents the martensite transformation start temperature from decreasing while maintaining hardenability. B also has an effect of suppressing occurrence of ferrite and pearlite during cooling after finish rolling in hot rolling. The B content needs to be 0.0002% or more and preferably 0.0003% or more to obtain these effects. The effects are saturated at a B content exceeding 0.0050%. Accordingly, the B content is 0.0050% or less and is preferably 0.0040% or less.

At least one selected from V: 0.10% or less and Nb: 0.10% or less, at least one selected from Cr: 0.50% or less, Mo: 0.50% or less, Cu: 0.50% or less, and Ni: 0.50% or less, and at least one selected from Ca: 0.0050% or less and REM: 0.0050% or less may be added to the above-described components separately or simultaneously for the following reasons.

V: 0.10% or Less

Vanadium (V) contributes to increasing strength by forming fine carbonitrides. The V content is preferably 0.01% or more to obtain this effect. However, addition of more than 0.10% of V has a small strength-increasing effect and increases the alloying cost. Accordingly, the V content is 0.10% or less.

Nb: 0.10% or Less

As with V, Nb also contributes to increasing strength by forming fine carbonitrides and thus may be added if needed. The Nb content is preferably 0.005% or more to obtain this effect. The Nb content is 0.10% or less since addition of a large amount of Nb significantly decreases elongation.

Cr: 0.50% or Less

Chromium (Cr) is an element that contributes to increasing strength by forming a second phase and may be added if needed. The Cr content is preferably 0.10% or more to obtain this effect. Martensite occurs excessively at a Cr content exceeding 0.50%. Thus, the Cr content is 0.50% or less.

Mo: 0.50% or Less

As with Cr, molybdenum (Mo) is an element that contributes to increasing strength by forming a second phase. Mo is also an element that contributes to increasing strength by partly forming carbides and may be added if needed. The Mo content is preferably 0.05% or more to obtain these effects. The Mo content is 0.50% or less since the effects are saturated at Mo content exceeding 0.50%.

Cu: 0.50% or Less

As with Cr, copper (Cu) is an element that contributes to increasing strength by forming a second phase. Cu is also an element that contributes to increasing strength by solid solution strengthening and may be added if needed. The Cu content is preferably 0.05% or more to obtain these effects. The effects are saturated and surface defects caused by Cu tend to occur at a Cu content exceeding 0.50%. Thus, the Cu content is 0.50% or less.

Ni: 0.50% or Less

As with Cu, nickel (Ni) is an element that contributes to increasing strength by forming a second phase and contributes to increasing strength by solid solution strengthening, and may be added if needed. The Ni content is preferably 0.05% or more to obtain these effects. When added together with Cu, Ni has an effect of suppressing surface defects caused by Cu. Thus, Ni is particularly useful when Cu is added. The effect is saturated at a Ni content exceeding 0.50%. Thus, the Ni content is 0.50% or less.

Ca: 0.0050% or Less

Calcium (Ca) is an element that makes sulfides spherical and contributes to overcoming adverse effects of sulfides on stretch flangeability, and may be added if needed. The Ca content is preferably 0.0005% or more to obtain these effects. The Ca content is 0.0050% or less since the effects are saturated at a Ca content exceeding 0.0050%.

REM: 0.0050% or Less

As with Ca, REM is also an element that makes sulfide spherical and contributes to overcoming adverse effects of sulfides on stretch flangeability, and may be added if needed. The REM content is preferably 0.0005% or more to obtain these effects. The REM content is 0.0050% or less since the effects are saturated at a REM content exceeding 0.0050%.

The balance other than the components described above is Fe and unavoidable impurities. Examples of the unavoidable impurities include Sb, Sn, Zn, and Co, and the allowable content ranges of these unavoidable impurities are Sb: 0.01% or less, Sn: 0.1% or less, Zn: 0.01% or less, and Co: 0.1% or less. Addition of Ta, Mg, and Zr within ranges of typical steel compositions does not cause loss of the effects.

The microstructure of our high-strength cold rolled steel sheet will now be described in detail.

Ferrite Average Grain Size: 7 μm or Less, and Ferrite Volume Fraction: 20% to 55%

The amount of soft ferrite is small and elongation is decreased at a ferrite volume fraction less than 20%. Thus, the ferrite volume fraction is 20% or more and preferably 25% or more. At a ferrite volume fraction exceeding 55%, a large amount of a hard second phase occurs and there will be many spots where the difference in hardness between the hard second phase and the soft ferrite is large, resulting in decreased stretch flangeability. It becomes difficult to obtain a strength of 980 MPa or more at a ferrite volume fraction exceeding 55%. Accordingly, the ferrite volume fraction is 55% or less and preferably 50% or less. At a ferrite average grain size exceeding 7 μm, voids that have occurred at punched edge faces easily connect to one another during hole expansion, in other words, the voids that have occurred at punched edge faces connect to one another during a stretch flanging process. Thus, satisfactory stretch flangeability is not obtained. Since decreasing the ferrite grain diameter is effective to increase the yield ratio, the ferrite average grain size is 7 μm or less. From the viewpoint of bendability, the lower limit of the ferrite average grain size is preferably 5 μm since segregation can be suppressed.

Retained Austenite Volume Fraction: 5 to 15%

The retained austenite volume fraction needs to be 5% or more to obtain desirable elongation. The retained austenite volume fraction is preferably 6% or more. Stretch flangeability is degraded at a retained austenite volume fraction exceeding 15%. Accordingly, the retained austenite volume fraction is 15% or less and preferably 13% or less.

Martensite Average Grain Size: 4 μm or Less and Martensite Volume Fraction: 0.5 to 7%

The martensite volume fraction needs to be 0.5% or more to obtain desired strength. The martensite volume fraction is 7% or less to obtain satisfactory stretch flangeability. Voids that occur at the interface with ferrite easily connect to one another and stretch flangeability is degraded at a martensite average grain size exceeding 4 μm. Accordingly, the upper limit of the martensite average grain size is 4 μm. The martensite discussed here refers to martensite that occurs when austenite that has remained untransformed even after holding a second soaking temperature of 350° C. to 500° C. during annealing is cooled to room temperature.

Average Grain Size of Structure Composed of Bainite and/or Tempered Martensite: 6 μm or Less Bainite and tempered martensite in a high-strength cold rolled steel sheet can increase yield strength and offer a high yield ratio, as well as satisfactory stretch flangeability. Bainite and tempered martensite have the same effects regarding the yield ratio and stretch flangeability. The steel sheet must contain a structure composed of bainite and/or tempered martensite and having an average grain size of 6 μm or less. When the average grain size of the structure composed of bainite and/or tempered martensite exceeds 6 μm, voids that have occurred at the punched edge faces easily connect to one another during a stretch flanging process such as a hole expansion process, and thus satisfactory stretch flangeability is not obtained. Accordingly, the average grain size of the structure composed of bainite and/or tempered martensite is 6 μm or less.

Bainite and tempered martensite can be identified by detailed structural observation with a field emission scanning electron microscope (FE-SEM), through electron backscatter diffraction (EBSD), or with a transmission electron microscope (TEM). When bainite and tempered martensite are identified through such structural observation, the bainite volume fraction is preferably 10 to 25% and the tempered martensite volume fraction is preferably 20 to 50%. The bainite volume fraction discussed here refers to a volume ratio of bainitic ferrite (ferrite with high dislocation density) occupying the observation area. Tempered martensite refers to martensite obtained when martensite obtained as a result of martensite transformation of part of untransformed austenite during cooling to a cooling end temperature during annealing undergoes tempering under heating at 350° C. to 500° C.

Difference in Nano-Hardness Between Ferrite and Structure Composed of Bainite and/or Tempered Martensite: 3.5 GPa or Less The difference in nano-hardness between ferrite and the structure composed of bainite and/or tempered martensite needs to be 3.5 GPa or less to obtain satisfactory stretch flangeability. Voids that have occurred at the interface with ferrite during a punching process easily connect to one another and stretch flangeability is degraded when the difference in nano-hardness exceeds 3.5 GPa.

Difference in Nano-Hardness Between Structure Composed of Bainite and/or Tempered Martensite and Martensite: 2.5 GPa or Less The difference in nano-hardness between the structure composed of bainite and/or tempered martensite and martensite needs to be 2.5 GPa or less to obtain satisfactory stretch flangeability. Voids that have occurred at the interface with martensite during a punching process easily connect to one another and the stretch flangeability is degraded when the difference in nano-hardness exceeds 2.5 GPa.

The high-strength cold rolled steel sheet preferably has a structure containing the ferrite, retained austenite, and martensite within the volume fraction ranges described above, with the balance being bainite and/or tempered martensite. There may be cases where one or more structures such as pearlite, spherical cementite, and the like occur in addition to ferrite, retained austenite, martensite, bainite, and tempered martensite described above. Our steel sheets are effective as long as the volume fractions of the ferrite, retained austenite, and martensite, the average grain sizes of the ferrite and martensite, the average grain size of bainite and/or tempered martensite, the difference in nano-hardness between ferrite and bainite and/or tempered martensite, and the difference in nano-hardness between bainite and/or tempered martensite and martensite are satisfied as described above. However, the total volume fraction of structures such as pearlite and spherical cementite, other than ferrite, retained austenite, martensite, bainite, and tempered martensite is preferably 5% or less.

Next, a method of producing a high-strength cold rolled steel sheet is described.

A method of producing a high-strength cold rolled steel sheet includes a hot rolling step, a pickling step, a cold rolling step, and an annealing step described below. In the hot rolling step, the following is performed: A steel slab having the composition (chemical composition) described above is hot-rolled under conditions of hot rolling start temperature: 1150° C. to 1300° C. and finishing delivery temperature: 850° C. to 950° C., cooling is started within 1 s after completion of hot rolling, and the resulting product is cooled (first cooling) to 650° C. or lower at a first average cooling rate of 80° C./s or more, then cooled (second cooling) to 550° C. or lower at a second average cooling rate of 5° C./s or more, and coiled at a coiling temperature of 550° C. or lower. The resulting hot rolled steel sheet is pickled in the pickling step, and cold-rolled in the cold rolling step. In the annealing step, the cold-rolled steel sheet is heated to a first soaking temperature in a temperature zone of 750° C. or higher at an average heating rate of 3 to 30° C./s, held at the first soaking temperature for 30 s or longer, cooled from the first soaking temperature to a cooling end temperature of 150° C. to 350° C. at a third average cooling rate of 3° C./s or more, heated to a second soaking temperature in a temperature zone of 350° C. to 500° C., held at the second soaking temperature for 20 s or longer, and cooled to room temperature.

The method of producing a high-strength cold rolled steel sheet will now be described in detail.

Hot Rolling Step

In the hot rolling step, a steel slab after casting is begun to be hot-rolled at 1150° C. to 1300° C. without re-heating, or re-heated to 1150° C. to 1300° C. and then hot-rolled. The steel slab used is preferably produced by a continuous casting method to prevent macrosegregation of components. The steel slab can be produced by an ingoting method or a thin slab casting method. A conventional method of cooling a produced steel slab to room temperature and then re-heating the steel slab can be applied as well as energy-saving processes such as directly charging a hot steel slab into a heating furnace without cooling, rolling the steel slab immediately after performing heat holding, and rolling a steel slab as casted (direct rolling).

Hot Rolling Start Temperature: 1150° C. to 1300° C.

At a hot rolling start temperature less than 1150° C., rolling load is increased and productivity is decreased. Thus, the hot rolling start temperature needs to be 1150° C. or higher. A hot rolling start temperature exceeding 1300° C. only increases the cost of heating the steel slab. Thus, the hot rolling start temperature is 1300° C. or lower.

Finishing Delivery Temperature: 850° C. to 950° C.

Hot rolling needs to end in an austenite single phase zone to improve elongation and stretch flangeability after annealing by homogenizing the structure in the steel sheet and decreasing anisotropy of the materials. Thus, the finishing delivery temperature of the hot rolling is 850° C. or higher. When the finishing delivery temperature exceeds 950° C., the structure of the hot rolled steel sheet coarsens and properties after annealing are degraded. Thus, the finishing delivery temperature needs to be 950° C. or lower. Accordingly, the finishing delivery temperature is 850° C. or more and 950° C. or less.

Cooling is Started within 1 s after Completion of Hot Rolling and Cooling is Performed to 650° C. or Lower at First Average Cooling Rate of 80° C./s or More After completion of hot rolling, quenching is performed to a temperature zone where bainite transformation occurs without ferrite transformation to control the steel sheet structure of the hot rolled steel sheet. The hot rolled steel sheet thus prepared is then rapidly heated in the subsequent annealing step to make the annealed steel sheet structure finer and decrease the difference in nano-hardness, which results in improved stretch flangeability. Distribution of elements such as C and Mn in the hot rolled steel sheet becomes inhomogeneous if ferrite and pearlite occur excessively in the structure of the hot rolled steel sheet. As discussed above, performing rapid heating during annealing makes the steel structure finer and improves stretch flangeability. If the distribution of elements such as C and Mn in the hot rolled steel sheet is inhomogeneous, C, Mn and the like, cannot be sufficiently dispersed during annealing. As a result, although the steel sheet structure may become finer after annealing, the difference in hardness between the structure composed of bainite and/or tempered martensite and martensite is increased and stretch flangeability is degraded. Accordingly, cooling after finish rolling and rapid heating during annealing are both important. Accordingly, after finish rolling, cooling is started within 1 s after completion of hot rolling, and cooling is performed to 650° C. or lower as first cooling at a first average cooling rate of 80° C./s or more.

When first cooling is started not within 1 s after completion of hot rolling or when the first average cooling rate, i.e., the cooling rate of the first cooling, is less than 80° C./s, ferrite transformation starts, the steel sheet structure of the hot rolled steel sheet becomes inhomogeneous, and stretch flangeability after annealing is degraded. When the end temperature of the first cooling exceeds 650° C., pearlite occurs excessively, the steel sheet structure of the hot rolled steel sheet becomes inhomogeneous, and stretch flangeability after annealing is degraded. Thus, cooling must start within 1 s after completion of hot rolling and cooling to 650° C. or lower must be performed at a first average cooling rate of 80° C./s or more. The first average cooling rate discussed here refers to an average cooling rate from the finishing delivery temperature to the first cooling end temperature.

Cooling to 550° C. or Lower at Second Average Cooling Rate of 5° C./s or More

The first cooling described above is followed by second cooling. The second cooling includes performing cooling to 550° C. or lower at a second average cooling rate of 5° C./s or more. Ferrite or pearlite occurs excessively in the steel sheet structure of the hot rolled steel sheet and stretch flangeability after annealing is degraded if the second average cooling rate is less than 5° C./s or the second cooling end temperature is higher than 550° C. The second average cooling rate discussed here refers to the average cooling rate from the first cooling end temperature to the coiling temperature.

Coiling Temperature: 550° C. or Lower

After the second cooling, the hot rolled steel sheet is coiled into a coil shape. If the coiling temperature exceeds 550° C., ferrite and pearlite occur excessively. Thus, the upper limit of the coiling temperature is 550° C., and preferably 500° C. or lower. The lower limit of the coiling temperature is not particularly specified. However, hard martensite occurs excessively and cold rolling load is increased if the coiling temperature is excessively low. The lower limit is thus preferably 300° C. or higher.

Pickling Step

After the hot rolling step described above, pickling is performed to remove scale on the surface layers of the hot rolled steel sheet obtained in the hot rolling step. The conditions of the pickling step are not particularly limited and normal conditions may be employed.

Cold Rolling Step

The hot rolled steel sheet after pickling is subjected to a cold rolling step that involves rolling the hot rolled steel sheet to a particular sheet thickness to form a cold rolled sheet. The conditions of the cold rolling step are not particularly limited, and normal conditions may be employed. Intermediate annealing may be performed before the cold rolling step to decrease the cold rolling load. The time and temperature of the intermediate annealing are not particularly limited. For example, if batch annealing is to be conducted on a coil, annealing is preferably performed at 450° C. to 800° C. for 10 minutes to 50 hours.

Annealing Step

In the annealing step, the cold rolled sheet obtained in the cold rolling step is annealed to allow recrystallization and form bainite, tempered martensite, retained austenite, and martensite in the steel sheet structure to increase the strength. Accordingly, in the annealing step, heating is performed to a temperature zone of 750° C. or higher at an average heating rate of 3 to 30° C./s, a first soaking temperature of 750° C. or higher is held for 30 s or longer, cooling is performed from the first soaking temperature to a cooling end temperature of 150° C. to 350° C. at a third average cooling rate of 3° C./s or more, heating is performed to a second soaking temperature in the temperature zone of 350° C. to 500° C., the second soaking temperature is held for 20 s or longer, and cooling is performed to room temperature.

Performing Heating to Temperature Zone of 750° C. or Higher at Average Heating Rate: 3 to 30° C./s The heating rate to perform heating to a temperature zone of 750° C. or higher, which is the ferrite/austenite dual phase zone or austenite singe phase zone, to make the rate of nucleation ferrite and austenite occurs by recrystallization during the annealing step to be larger than the grain growth rates of these structures and makes crystal grains finer after annealing. Since decreasing the ferrite grain diameter has an effect of increasing yield ratio, it is important to make ferrite grains finer by controlling the heating rate. Ferrite grains become coarse and the desirable ferrite grain diameter is not obtained when the average heating rate to perform heating to a temperature zone of 750° C. or higher is less than 3° C./s. Accordingly, the average heating rate needs to be 3° C./s or more, and is preferably 5° C./s or more. However, recrystallization is obstructed at an excessively large heating rate. Thus, the upper limit of the average heating rate is 30° C./s. Heating at this heating rate must be performed to a temperature zone of 750° C. or higher. When heating at this average heating rate is performed to a temperature lower than 750° C., the ferrite volume fraction is increased and the desirable steel sheet structure cannot be obtained. Thus, the heating at the average heating rate described above must be performed up to a temperature zone of 750° C. or higher. The average heating rate discussed here refers to an average heating rate from room temperature to the first soaking temperature.

First Soaking Temperature: 750° C. or Higher

When the soaking temperature (first soaking temperature) is lower than 750° C., the volume fraction of austenite that occurs during annealing is small and thus bainite and tempered martensite that can offer high yield ratios cannot be obtained. Accordingly, the lower limit of the first soaking temperature is 750° C. The upper limit is not particularly specified. However, it may become difficult to obtain a ferrite volume fraction required for elongation if the first soaking temperature is excessively high. Thus, the upper limit is preferably 880° C. or lower.

Soaking Time: 30 s or Longer

The soaking time at the first soaking temperature needs to be 30 s or longer to allow recrystallization and transform all or some parts of the steel sheet structure into austenite at the first soaking temperature described above. The upper limit of the soaking time is not particularly limited.

Performing Cooling from First Soaking Temperature to Cooling end Temperature in Temperature Zone of 150° C. to 350° C. at Cooling Rate (Third Average Cooling Rate) of 3° C./s or More The steel sheet after soaking is cooled from the first soaking temperature to a temperature zone of 150° C. to 350° C., which is the range not higher than the martensite transformation start temperature to transform some parts of austenite generated during soaking at the first soaking temperature into martensite. If the third average cooling rate, which is the average cooling rate from the first soaking temperature, is less than 3° C./s, pearlite and spherical cementite occur excessively in the steel sheet structure. Accordingly, the lower limit of the third average cooling rate is 3° C./s. Although the upper limit of the third average cooling rate is not particularly specified, the upper limit is preferably 40° C./s or less to obtain a desirable steel sheet structure. At a cooling end temperature lower than 150° C., martensite occurs excessively during cooling, the amount of untransformed austenite is decreased, and bainite transformation and retained austenite are decreased, resulting in lower elongation. Tempered martensite is decreased and the stretch flangeability is decreased at a cooling end temperature higher than 350° C. Accordingly, the cooling end temperature is 150° C. to 350° C. and preferably 150° C. to 300° C.

Second Soaking Temperature: 350° C. to 500° C.

Cooling at the third average cooling rate is followed by heating to a second soaking temperature in a temperature zone of 350° C. to 500° C. Performing heating to the second soaking temperature generates tempered martensite by tempering martensite that has occurred during cooling, transforms untransformed austenite into bainite, and generates bainite and retained austenite in the steel sheet structure. Accordingly, after cooling from the first soaking temperature, re-heating is performed to a second soaking temperature in the temperature zone of 350° C. to 500° C. and the temperature zone of 350° C. to 500° C. is held for 20 s or longer. At a second soaking temperature lower than 350° C., martensite is insufficiently tempered and the difference in hardness between ferrite and tempered martensite is increased, resulting in degraded stretch flangeability. At a second soaking temperature higher than 500° C., pearlite occurs excessively and thus elongation is decreased. Accordingly, the second soaking temperature is 350° C. or higher and 500° C. or lower.

Second Soaking Temperature Holding Time: 20 s or Longer

If the time for which the second soaking temperature is held is shorter than 20 s, bainite transformation does not proceed sufficiently, a large amount of untransformed austenite remains, martensite is ultimately generated excessively, and stretch flangeability is degraded. Accordingly, the second soaking temperature holding time is 20 s or longer. The upper limit of the holding time is not particularly specified but is preferably 3000 s or shorter to allow bainite transformation.

Temper Rolling

Temper rolling may be performed after annealing. A preferable range of elongation is 0.1% to 2.0%.

In the annealing step, galvanization may be conducted to form a galvanized steel sheet or an alloying treatment may be performed after galvanization to form a galvannealed steel sheet. The cold rolled steel sheet may be electroplated to obtain an electroplated steel sheet.

Example 1

Examples will now be described. This disclosure is not limited by the Examples described below, and may be implemented with modifications and alterations without departing from the essence of the disclosure. Such modifications and the like, are all included in the technical scope of our steel sheets and methods.

Steels having chemical compositions shown in Table 1 were melted and casted to produce slabs. The slabs were hot-rolled at a slab heating temperature (hot rolling start temperature) of 1250° C. and finishing delivery temperatures (FDT) shown in Table 2 to form hot rolled steel sheets having a sheet thickness of 3.2 mm. After completion of hot rolling, cooling was started within a time T (s) shown in Table 2, cooling was performed to a first cooling temperature at a first average cooling rate (cooling rate 1) shown in Table 2, and then cooling was further performed to a coiling temperature (CT) shown in Table 2 at a second average cooling rate (cooling rate 2), followed by performing a process equivalent to coiling. Then the resulting hot rolled steel sheets were each pickled and cold-rolled to obtain cold rolled sheets (sheet thickness: 1.4 mm). Then, each cold rolled sheet was heated to a first soaking temperature shown in Table 2 at an average heating rate shown in Table 2, annealed by being held thereat for the soaking time (first holding time), and cooled to a cooling end temperature at a cooling rate (cooling rate 3) shown in Table 2. Then the sheet was heated, held at a second soaking temperature shown in Table 2 (second holding time), and cooled to room temperature. As a result, a high-strength cold rolled steel sheets were produced.

Various properties of the steel sheets produced were evaluated as described below. The results are shown in Table 3.

Tensile Properties

A JIS No. 5 tensile test specimen was taken from each steel sheet thus prepared so that a direction perpendicular to the rolling direction matched the longitudinal direction (tensile direction) of the specimen, and subjected to a tensile test (JIS Z2241 (1998)) to determine yield stress (YS), tensile strength (TS), total elongation (EL), and yield ratio (YR).

Stretch Flangeability

A specimen taken from the produced steel sheet was punched to form a hole having a diameter of 10 mm at a clearance of 12.5% according to the Japan Iron and Steel Federation standards (JFS T1001 (1996)) and set in a tester such that the burr would face the die. Then a 60° conical punch was used to perform forming to measure the hole expanding ratio (λ). Those specimens having λ (%) of 50% or more were assumed to be steel sheets having satisfactory stretch flangeability.

Steel Sheet Structure

The volume fractions of ferrite and martensite of a steel sheet were determined by polishing a sheet thickness cross section taken in a direction parallel to the rolling direction of the steel sheet, corroding the cross section with a 3% nital, observing the corroded cross section with a scanning electron microscope (SEM) at a magnification factor of 2000, and determining the volume fractions by using Image-Pro produced by Media Cybernetics. Specifically, the area ratios were measured by a point count method (in accordance with ASTM E562-83 (1988)) and the area ratios were assumed to be the volume fractions. The average grain sizes of ferrite and martensite were determined by capturing, by using Image-Pro, a photograph taken from the steel sheet structure photograph in which ferrite and martensite crystal grains had been previously identified, calculating the area of each phase, calculating the equivalent circle diameter of each phase, and averaging the results.

The volume fraction of retained austenite was determined by polishing a steel sheet to expose a surface at a depth of ¼ of the sheet thickness, and measuring diffraction X-ray intensities at the surface at the depth of ¼ of the sheet thickness. By using a K-α line of Mo as a line source, X-ray diffraction (instrument: RINT 2200 produced by Rigaku Corporation) was performed at an acceleration voltage of 50 keV to measure the integrated intensities of X-ray diffracted lines of the {200} plane, {211} plane, and {220} plane of iron ferrite and the {200} plane, {220} plane, and {311} plane of austenite. The observed values were substituted into calculation formulae described in pp. 26 and 62 to 64 of "Handbook of X-ray Diffraction" (2000) published by Rigaku Denki Corporation to determine the volume fraction of retained austenite.

The average grain size of the structure composed of bainite and/or tempered martensite was determined by calculating the equivalent circle diameters from a steel sheet structure photograph using Image-Pro described above and averaging the results.

Nano-Hardness

The nano-hardness of ferrite, martensite, or a structure composed of bainite and/or tempered martensite was determined by measuring the nano-hardness of 10 positions selected from a part at a depth of ¼ of the sheet thickness from the steel sheet surface, at a depression load of 1000 μN through atomic force microscope (AFM) nano-indentation, and averaging the results. The individual structures were identified by structural observation of the part subjected to hardness measurement with a scanning electron microscope (SEM) after measuring the nano-hardness.

The measured tensile properties, stretch flangeability, differences in nano-hardness, and the steel sheet structure are shown in Table 3. All of our examples contained a volume fraction of 20% to 55% of ferrite having an average grain size of 7 μm or less, a volume fraction of 5% to 15% of retained austenite, a volume fraction of 0.5% to 7% of martensite having an average grain size of 4 μm or less, and the balance being a multiphase structure containing bainite and/or tempered martensite and having an average grain size of 6 μm or less. In all our examples, the difference in nano-hardness between ferrite and the structure composed of bainite and/or tempered martensite is 3.5 GPa or less, and the difference in nano-hardness between the structure composed of bainite and/or tempered martensite and martensite was 2.5 GPa or less. As a result, our examples have satisfactory workability such as a tensile strength of 980 MPa or more, a yield ratio of 80% or more, an elongation of 17% or more, and a hole expanding ratio of 50% or more. In contrast, the Comparative Examples have steel components and steel sheet structures outside our range and, as a result, none of them satisfy all of the tensile strength, yield ratio, elongation, and hole expanding ratio.

TABLE 1

| Steel | Chemical composition (mass %) | | | | | | | | | | |
|---|---|---|---|---|---|---|---|---|---|---|---|
| type | C | Si | Mn | P | S | Al | N | Ti | B | Others | Note |
| A | 0.09 | 1.61 | 2.88 | 0.01 | 0.002 | 0.03 | 0.002 | 0.016 | 0.0012 | — | Steel within scope |
| B | 0.11 | 1.51 | 2.71 | 0.01 | 0.001 | 0.03 | 0.003 | 0.012 | 0.0016 | — | Steel within scope |
| C | 0.13 | 1.99 | 2.41 | 0.01 | 0.001 | 0.03 | 0.003 | 0.010 | 0.0010 | — | Steel within scope |
| D | 0.12 | 1.39 | 2.81 | 0.01 | 0.001 | 0.03 | 0.002 | 0.005 | 0.0022 | V: 0.02 | Steel within scope |
| E | 0.08 | 1.77 | 2.68 | 0.01 | 0.002 | 0.03 | 0.002 | 0.006 | 0.0012 | Nb: 0.02 | Steel within scope |
| F | 0.12 | 1.42 | 2.53 | 0.01 | 0.001 | 0.03 | 0.002 | 0.015 | 0.0018 | Cr: 0.20 | Steel within scope |

TABLE 1-continued

| Steel type | Chemical composition (mass %) C | Si | Mn | P | S | Al | N | Ti | B | Others | Note |
|---|---|---|---|---|---|---|---|---|---|---|---|
| G | 0.13 | 0.98 | 2.40 | 0.01 | 0.001 | 0.03 | 0.002 | 0.031 | 0.0010 | Mo: 0.20 | Steel within scope |
| H | 0.11 | 2.25 | 2.55 | 0.01 | 0.001 | 0.03 | 0.003 | 0.022 | 0.0005 | Cu: 0.10 | Steel within scope |
| I | 0.08 | 1.16 | 3.02 | 0.01 | 0.002 | 0.03 | 0.002 | 0.012 | 0.0012 | Ni: 0.10 | Steel within scope |
| J | 0.10 | 1.35 | 2.79 | 0.02 | 0.002 | 0.03 | 0.002 | 0.015 | 0.0022 | Ca: 0.0035 | Steel within scope |
| K | 0.13 | 1.41 | 2.81 | 0.01 | 0.002 | 0.03 | 0.002 | 0.026 | 0.0028 | REM: 0.0028 | Steel within scope |
| L | 0.20 | 1.50 | 2.38 | 0.01 | 0.002 | 0.03 | 0.002 | 0.031 | 0.0030 | — | Comparative Example |
| M | 0.10 | 0.48 | 2.66 | 0.01 | 0.002 | 0.02 | 0.003 | 0.017 | 0.0021 | — | Comparative Example |
| N | 0.12 | 2.12 | 1.80 | 0.01 | 0.002 | 0.03 | 0.003 | 0.015 | 0.0020 | — | Comparative Example |
| O | 0.08 | 0.81 | 3.82 | 0.02 | 0.002 | 0.04 | 0.002 | 0.030 | 0.0010 | — | Comparative Example |
| P | 0.11 | 1.35 | 3.35 | 0.02 | 0.001 | 0.03 | 0.002 | 0.012 | — | — | Comparative Example |

Underlined items are outside the scope of this disclosure.

TABLE 2

| | | Hot rolling conditions | | | | | | Annealing conditions | | | | | | |
|---|---|---|---|---|---|---|---|---|---|---|---|---|---|---|
| Sample No | Steel type | T (s) | FDT (° C.) | Cooling rate 1 (° C./s) | First cooling temperature (° C.) | Cooling rate 2 (° C./s) | CT (° C.) | Average heating rate (° C./s) | First soaking temperature (° C.) | First holding time (s) | Cooling rate 3 (° C./s) | Cooling end temperature (° C.) | Second soaking temperature (° C.) | Second holding time (s) |
| 1 | A | 0.5 | 900 | 100 | 620 | 20 | 470 | 5 | 825 | 350 | 5 | 250 | 400 | 600 |
| 2 | A | 0.5 | 900 | 100 | 600 | 20 | 470 | 10 | 800 | 200 | 4 | 200 | 400 | 600 |
| 3 | B | 1 | 900 | 120 | 550 | 30 | 470 | 15 | 800 | 240 | 6 | 225 | 400 | 300 |
| 4 | B | 0.5 | 900 | 100 | 600 | 20 | 470 | 10 | 820 | 240 | 8 | 250 | 425 | 600 |
| 5 | B | 0.5 | 900 | 90 | 600 | 20 | 400 | 10 | 780 | 300 | 5 | 180 | 450 | 600 |
| 6 | C | 0.5 | 900 | 110 | 620 | 20 | 470 | 20 | 830 | 120 | 4 | 200 | 400 | 300 |
| 7 | C | 0.5 | 900 | 100 | 600 | 30 | 470 | 10 | 800 | 400 | 5 | 150 | 350 | 600 |
| 8 | D | 0.5 | 900 | 150 | 600 | 20 | 420 | 10 | 800 | 300 | 15 | 200 | 350 | 1000 |
| 9 | E | 0.5 | 900 | 100 | 580 | 20 | 470 | 25 | 800 | 300 | 5 | 250 | 380 | 600 |
| 10 | F | 0.5 | 900 | 100 | 620 | 40 | 470 | 10 | 800 | 600 | 4 | 200 | 400 | 600 |
| 11 | G | 0.5 | 900 | 100 | 550 | 20 | 470 | 10 | 800 | 300 | 8 | 250 | 450 | 600 |
| 12 | H | 0.5 | 900 | 85 | 600 | 15 | 540 | 5 | 800 | 300 | 7 | 200 | 400 | 600 |
| 13 | I | 0.5 | 900 | 100 | 600 | 20 | 470 | 3 | 800 | 500 | 6 | 200 | 500 | 300 |
| 14 | J | 1 | 900 | 100 | 600 | 20 | 470 | 10 | 800 | 300 | 8 | 250 | 450 | 180 |
| 15 | K | 0.5 | 900 | 100 | 600 | 20 | 470 | 4 | 800 | 300 | 11 | 300 | 400 | 500 |
| 16 | B | 0.5 | 900 | 50 | 600 | 20 | 470 | 10 | 800 | 300 | 5 | 250 | 430 | 600 |
| 17 | B | 0.5 | 900 | 90 | 750 | 25 | 470 | 10 | 800 | 300 | 5 | 250 | 450 | 600 |
| 18 | B | 0.5 | 900 | 100 | 600 | 2 | 470 | 10 | 800 | 300 | 6 | 300 | 400 | 600 |
| 19 | B | 0.5 | 900 | 85 | 720 | 20 | 650 | 10 | 800 | 300 | 7 | 300 | 400 | 600 |
| 20 | B | 0.5 | 900 | 100 | 600 | 20 | 470 | 1 | 800 | 300 | 5 | 250 | 400 | 600 |
| 21 | B | 0.5 | 900 | 100 | 600 | 20 | 470 | 10 | 740 | 300 | 12 | 250 | 400 | 600 |
| 22 | B | 0.5 | 900 | 100 | 600 | 20 | 470 | 10 | 825 | 300 | 1 | 220 | 400 | 600 |
| 23 | B | 0.5 | 900 | 100 | 600 | 20 | 470 | 10 | 850 | 250 | 5 | 400 | 500 | 600 |
| 24 | B | 0.5 | 900 | 100 | 550 | 20 | 470 | 10 | 850 | 300 | 6 | 120 | 380 | 600 |
| 25 | B | 1 | 900 | 100 | 600 | 20 | 450 | 10 | 820 | 300 | 5 | 250 | 550 | 600 |
| 26 | B | 0.5 | 900 | 100 | 550 | 20 | 450 | 10 | 820 | 300 | 6 | 250 | 300 | 500 |
| 27 | B | 0.5 | 900 | 100 | 600 | 20 | 470 | 10 | 820 | 200 | 7 | 250 | 400 | 10 |
| 28 | L | 0.5 | 900 | 120 | 550 | 20 | 450 | 10 | 820 | 300 | 5 | 250 | 400 | 300 |
| 29 | M | 0.5 | 900 | 100 | 600 | 20 | 450 | 10 | 800 | 250 | 6 | 250 | 450 | 500 |
| 30 | N | 0.5 | 900 | 100 | 550 | 20 | 450 | 10 | 800 | 300 | 5 | 250 | 450 | 500 |
| 31 | O | 0.5 | 900 | 100 | 600 | 20 | 470 | 10 | 800 | 300 | 6 | 250 | 400 | 300 |
| 32 | P | 0.5 | 900 | 100 | 600 | 20 | 470 | 10 | 800 | 300 | 6 | 250 | 400 | 350 |

Underlined items are outside the scope of this disclosure.

TABLE 3

| | Steel sheet structure | | | | | | | | | |
|---|---|---|---|---|---|---|---|---|---|---|
| | Ferrite | | Retained austenite | Martensite | | Balance structure | | Nano-hardness | | |
| | Volume fraction (%) | Average grain size (μm) | Volume fraction (%) | Volume fraction (%) | Average grain size (μm) | Type | Average grain size (μm) | F (GPa) | BTM (GPa) | M (GPa) |
| 1 | 38 | 4 | 7 | 2 | 3 | B, TM | 5 | 3.9 | 6.6 | 8.7 |
| 2 | 45 | 5 | 8 | 3 | 3 | B, TM | 4 | 4.1 | 7.2 | 9.1 |

TABLE 3-continued

| | | | | | | | | | | |
|---|---|---|---|---|---|---|---|---|---|---|
| 3 | 43 | 4 | 7 | 4 | 2 | B, TM | 4 | 4.0 | 6.8 | 8.7 |
| 4 | 36 | 3 | 8 | 4 | 2 | B, TM | 5 | 4.1 | 6.7 | 8.5 |
| 5 | 50 | 7 | 5 | 5 | 3 | B, TM | 4 | 4.1 | 6.5 | 8.9 |
| 6 | 27 | 4 | 5 | 4 | 3 | B, TM | 4 | 4.3 | 7.2 | 9.3 |
| 7 | 48 | 7 | 5 | 5 | 2 | B, TM | 6 | 4.6 | 7.9 | 9.7 |
| 8 | 41 | 5 | 7 | 1 | 2 | B, TM | 4 | 3.7 | 6.9 | 8.5 |
| 9 | 45 | 5 | 6 | 4 | 1 | B, TM | 4 | 4.2 | 7.1 | 9.1 |
| 10 | 45 | 6 | 6 | 3 | 2 | B, TM | 4 | 4.1 | 6.8 | 8.7 |
| 11 | 48 | 5 | 9 | 3 | 2 | B, TM | 5 | 3.7 | 6.5 | 8.7 |
| 12 | 46 | 4 | 7 | 3 | 3 | B, TM | 4 | 4.5 | 7.4 | 9.8 |
| 13 | 48 | 5 | 6 | 3 | 2 | B, TM | 4 | 4.1 | 6.8 | 9.0 |
| 14 | 49 | 6 | 5 | 4 | 2 | B, TM | 3 | 4.2 | 7.3 | 9.3 |
| 15 | 48 | 6 | 8 | 6 | 3 | B, TM | 4 | 4.2 | 7.4 | 9.6 |
| 16 | 39 | 6 | 6 | 4 | 4 | B, TM | 4 | 4.1 | 7.0 | 9.7 |
| 17 | 40 | 6 | 7 | 5 | 3 | B, TM | 4 | 4.0 | 7.6 | 9.9 |
| 18 | 43 | 5 | 5 | 4 | 4 | B, TM | 5 | 3.9 | 7.7 | 9.8 |
| 19 | 43 | 6 | 5 | 5 | 3 | B, TM | 4 | 4.0 | 7.4 | 10.0 |
| 20 | 41 | 8 | 6 | 4 | 5 | B, TM | 7 | 4.2 | 7.1 | 8.9 |
| 21 | 72 | 9 | 3 | 10 | 5 | B, TM | 4 | 4.0 | 7.0 | 9.1 |
| 22 | 63 | 8 | 2 | 5 | 3 | B, TM, P | 4 | 4.1 | 7.0 | 9.2 |
| 23 | 33 | 6 | 12 | 26 | 2 | B, TM | 3 | 4.2 | 7.0 | 9.8 |
| 24 | 22 | 5 | 2 | 2 | 3 | B, TM | 4 | 4.1 | 7.3 | 9.3 |
| 25 | 43 | 5 | 3 | 5 | 2 | B, TM, P | 4 | 4.0 | 5.9 | 9.1 |
| 26 | 40 | 6 | 6 | 14 | 5 | B, TM | 5 | 4.1 | 7.9 | 9.6 |
| 27 | 39 | 5 | 5 | 28 | 7 | B, TM | 4 | 4.0 | 7.5 | 9.3 |
| 28 | 41 | 5 | 6 | 3 | 2 | B, TM | 5 | 4.2 | 8.5 | 11.4 |
| 29 | 37 | 4 | 4 | 6 | 3 | B, TM | 5 | 3.5 | 7.9 | 10.1 |
| 30 | 61 | 8 | 3 | 3 | 3 | B, TM | 5 | 4.4 | 7.1 | 8.9 |
| 31 | 45 | 5 | 10 | 15 | 3 | B, TM | 4 | 3.6 | 8.1 | 10.8 |
| 32 | 39 | 4 | 9 | 10 | 4 | B, TM | 4 | 3.5 | 7.7 | 10.9 |

| | Difference in nano-hardness | | Tensile properties | | | | Hole expanding | |
|---|---|---|---|---|---|---|---|---|
| | BTM-F (GPa) | M-BTM (GPa) | YS (MPa) | Ts (MPa) | EL (%) | YR (%) | ratio λ (%) | Note |
| 1 | 2.7 | 2.1 | 822 | 1015 | 18.5 | 81 | 65 | Our Example |
| 2 | 3.1 | 1.9 | 834 | 1022 | 18.6 | 82 | 64 | Our Example |
| 3 | 2.8 | 1.9 | 883 | 1003 | 20.1 | 88 | 72 | Our Example |
| 4 | 2.6 | 1.8 | 865 | 998 | 20.2 | 87 | 78 | Our Example |
| 5 | 2.4 | 2.4 | 888 | 1025 | 20.5 | 87 | 71 | Our Example |
| 6 | 2.9 | 2.1 | 880 | 1005 | 19.6 | 88 | 78 | Our Example |
| 7 | 3.3 | 1.8 | 841 | 1013 | 19.1 | 83 | 59 | Our Example |
| 8 | 3.2 | 1.6 | 855 | 1024 | 19.6 | 83 | 61 | Our Example |
| 9 | 2.9 | 2.0 | 920 | 1061 | 19.1 | 87 | 77 | Our Example |
| 10 | 2.7 | 1.9 | 885 | 1051 | 18.6 | 84 | 70 | Our Example |
| 11 | 2.8 | 2.2 | 871 | 1023 | 18.3 | 85 | 61 | Our Example |
| 12 | 2.9 | 2.4 | 850 | 1033 | 18.6 | 82 | 55 | Our Example |
| 13 | 2.7 | 2.2 | 839 | 1019 | 19.5 | 82 | 65 | Our Example |
| 14 | 3.1 | 2.0 | 883 | 1033 | 19.6 | 85 | 81 | Our Example |
| 15 | 3.2 | 2.2 | 884 | 1029 | 18.8 | 86 | 65 | Our Example |
| 16 | 2.9 | 2.7 | 880 | 1033 | 17.9 | 85 | 48 | Comparative Example |
| 17 | 3.6 | 2.3 | 890 | 1031 | 18.1 | 86 | 45 | Comparative Example |
| 18 | 3.8 | 2.1 | 911 | 1065 | 17.6 | 86 | 39 | Comparative Example |
| 19 | 3.4 | 2.6 | 881 | 1088 | 17.5 | 81 | 35 | Comparative Example |
| 20 | 2.9 | 1.8 | 829 | 1028 | 16.3 | 81 | 44 | Comparative Example |
| 21 | 3.0 | 2.1 | 710 | 901 | 20.9 | 79 | 53 | Comparative Example |
| 22 | 2.9 | 2.2 | 690 | 889 | 17.8 | 78 | 32 | Comparative Example |
| 23 | 2.8 | 2.8 | 698 | 1015 | 18.0 | 69 | 20 | Comparative Example |
| 24 | 3.2 | 2.0 | 901 | 1022 | 15.1 | 88 | 88 | Comparative Example |
| 25 | 1.9 | 3.2 | 823 | 1003 | 15.5 | 82 | 33 | Comparative Example |
| 26 | 3.8 | 1.7 | 698 | 1025 | 17.9 | 68 | 21 | Comparative Example |
| 27 | 3.5 | 1.8 | 689 | 1045 | 18.3 | 66 | 23 | Comparative Example |
| 28 | 4.3 | 2.9 | 881 | 1033 | 17.9 | 85 | 25 | Comparative Example |
| 29 | 4.4 | 2.2 | 853 | 1029 | 18.0 | 3 | 24 | Comparative Example |
| 30 | 2.7 | 1.8 | 711 | 1005 | 18.6 | 71 | 52 | Comparative Example |
| 31 | 4.5 | 2.7 | 651 | 1032 | 18.8 | 63 | 21 | Comparative Example |
| 32 | 4.2 | 3.2 | 659 | 1056 | 17.3 | 62 | 19 | Comparative Example |

Underlined items are outside he scope of this disclosure.

Balance structure: B = bainite, TM = tempered martensite, P = pearlite

Nano-hardness: F = ferrite, BTM = structure composed of bainite and/or tempered martensite, M = martensite

The invention claimed is:

1. A high-yield-ratio, high-strength cold rolled steel sheet, comprising a composition and a microstructure, the composition comprising, in terms of percent by mass, C: 0.05% to 0.15%, Si: 0.6% to 2.5%, Mn: 2.2% to 3.5%, P: 0.08% or less, S: 0.010% or less, Al: 0.01% to 0.08%, N: 0.010% or less, Ti: 0.002% to 0.05%, B: 0.0002% to 0.0050%, and the balance being Fe and unavoidable impurities, the microstructure comprising a volume fraction of 20% to 55% of ferrite having an average grain size of 7 μm or less, a volume fraction of 5% to 15% of retained austenite, a volume fraction of 0.5% to 7% of martensite having an average grain size of 4 μm or less, and a structure composed of a balance of bainite and tempered martensite and having an average grain size of 6 μm or less, the bainite having a volume fraction of 10 to 25% and the tempered martensite having a volume fraction of 20 to 50%, and a difference in nano-hardness between the ferrite and the structure composed of bainite and/or tempered martensite being 3.5 GPa or less, and a difference in nano-hardness between the structure composed of bainite and/or tempered martensite and the martensite being 2.5 GPa or less, wherein the steel sheet has a yield ratio of 80% or more.

2. The steel sheet according to claim 1, wherein the composition further comprises, in terms of percent by mass, at least one selected from V: 0.10% or less and Nb: 0.10% or less.

3. The steel sheet according to claim 1, wherein the composition further comprises, in terms of percent by mass, at least one selected from Cr: 0.50% or less, Mo: 0.50% or less, Cu: 0.50% or less, and Ni: 0.50% or less.

4. The steel sheet according to claim 1, wherein the composition further comprises, in terms of percent by mass, at least one selected from Ca: 0.0050% or less and REM: 0.0050% or less.

5. A method of producing a high-yield-ratio, high-strength cold rolled steel sheet comprising:

providing a steel slab having a chemical composition described in claim 1, hot-rolling the steel slab under conditions of hot rolling start temperature: 1150° C. to 1300° C. and finishing delivery temperature: 850° C. to 950° C., starting cooling within 1 s after completion of hot rolling, performing cooling to 650° C. or lower at a first average cooling rate of 80° C./s or more as first cooling, performing cooling to 550° C. or lower at a second average cooling rate of 5° C./s or more as second cooling, performing coiling at a coiling temperature: 550° C. or lower, performing pickling and cold-rolling, performing heating to a temperature zone of 750° C. or higher at an average heating rate of 3 to 30° C./s, holding a first soaking temperature of 750° C. or higher for 30 s or longer, performing cooling from the first soaking temperature to a cooling end temperature in a temperature zone of 150° C. to 350° C. at a third average cooling rate of 3° C./s or more, performing heating to a second soaking temperature in a temperature zone of 350° C. to 500° C., holding the second soaking temperature for 20 s or longer, and performing cooling to room temperature.

6. The steel sheet according to claim 2, wherein the composition further comprises, in terms of percent by mass, at least one selected from Cr: 0.50% or less, Mo: 0.50% or less, Cu: 0.50% or less, and Ni: 0.50% or less.

7. The steel sheet according to claim 2, wherein the composition further comprises, in terms of percent by mass, at least one selected from Ca: 0.0050% or less and REM: 0.0050% or less.

8. The steel sheet according to claim 3, wherein the composition further comprises, in terms of percent by mass, at least one selected from Ca: 0.0050% or less and REM: 0.0050% or less.

9. A method of producing a high-yield-ratio, high-strength cold rolled steel sheet comprising:

providing a steel slab having a chemical composition described in claim 2, hot-rolling the steel slab under conditions of hot rolling start temperature: 1150° C. to 1300° C. and finishing delivery temperature: 850° C. to 950° C., starting cooling within 1 s after completion of hot rolling, performing cooling to 650° C. or lower at a first average cooling rate of 80° C./s or more as first cooling, performing cooling to 550° C. or lower at a second average cooling rate of 5° C./s or more as second cooling, performing coiling at a coiling temperature: 550° C. or lower, performing pickling and cold-rolling, performing heating to a temperature zone of 750° C. or higher at an average heating rate of 3 to 30° C./s, holding a first soaking temperature of 750° C. or higher for 30 s or longer, performing cooling from the first soaking temperature to a cooling end temperature in a temperature zone of 150° C. to 350° C. at a third average cooling rate of 3° C./s or more, performing heating to a second soaking temperature in a temperature zone of 350° C. to 500° C., holding the second soaking temperature for 20 s or longer, and performing cooling to room temperature.

10. A method of producing a high-yield-ratio, high-strength cold rolled steel sheet comprising:

providing a steel slab having a chemical composition described in claim 3, hot-rolling the steel slab under conditions of hot rolling start temperature: 1150° C. to 1300° C. and finishing delivery temperature: 850° C. to 950° C., starting cooling within 1 s after completion of hot rolling, performing cooling to 650° C. or lower at a first average cooling rate of 80° C./s or more as first cooling, performing cooling to 550° C. or lower at a second average cooling rate of 5° C./s or more as second cooling, performing coiling at a coiling temperature: 550° C. or lower, performing pickling and cold-rolling, performing heating to a temperature zone of 750° C. or higher at an average heating rate of 3 to 30° C./s, holding a first soaking temperature of 750° C. or higher for 30 s or longer, performing cooling from the first soaking temperature to a cooling end temperature in a temperature zone of 150° C. to 350° C. at a third average cooling rate of 3° C./s or more, performing heating to a second soaking temperature in a temperature zone of 350° C. to 500° C., holding the second soaking temperature for 20 s or longer, and performing cooling to room temperature.

11. A method of producing a high-yield-ratio, high-strength cold rolled steel sheet comprising:

providing a steel slab having a chemical composition described in claim 4, hot-rolling the steel slab under conditions of hot rolling start temperature: 1150° C. to 1300° C. and finishing delivery temperature: 850° C. to 950° C., starting cooling within 1 s after completion of hot rolling, performing cooling to 650° C. or lower at a first average cooling rate of 80° C./s or more as first cooling, performing cooling to 550° C. or lower at a second average cooling rate of 5° C./s or more as second cooling, performing coiling at a coiling temperature: 550° C. or lower, performing pickling and cold-rolling, performing heating to a temperature zone of 750° C. or higher at an average heating rate of 3 to 30° C./s, holding a first soaking temperature of 750° C. or higher for 30 s or longer, performing cooling from the first soaking temperature to a cooling end temperature in a temperature zone of 150° C. to 350° C. at a third average cooling rate of 3° C./s or more, performing heating to a second soaking temperature in a temperature zone of 350° C. to 500° C., holding the second soaking temperature for 20 s or longer, and performing cooling to room temperature.

12. The steel sheet according to claim 6, wherein the composition further comprises, in terms of percent by mass, at least one selected from Ca: 0.0050% or less and REM: 0.0050% or less.

* * * * *